US005590426A

United States Patent [19]

Moffre et al.

[11] Patent Number: 5,590,426

[45] Date of Patent: Jan. 7, 1997

[54] URINAL COVER

[76] Inventors: Mark C. Moffre; Alyssa B. LaPointe, both of 71 Bridgewood La., Watervliet, N.Y. 12189

[21] Appl. No.: 421,962

[22] Filed: Apr. 14, 1995

[51] Int. Cl.[6] ..... E03D 13/00

[52] U.S. Cl. ..... 4/301

[58] Field of Search ..... 4/301, 307, 310, 4/144.1, 580, DIG. 5, 450, 454, 455, 457

[56] References Cited

U.S. PATENT DOCUMENTS

| | | | |
|---|---|---|---|
| 134,315 | 12/1872 | Robinson | 4/301 |
| 1,091,352 | 3/1914 | Knowlton | 4/450 X |
| 1,109,824 | 9/1914 | Cook | 4/454 |
| 2,021,226 | 11/1935 | Davis | 4/455 |
| 3,172,130 | 9/1965 | Lange | 4/144.1 |

*Primary Examiner*—Charles E. Phillips
*Attorney, Agent, or Firm*—Richard L. Huff

[57] ABSTRACT

A urinal cover for out-of-order urinals in public restrooms. The urinal cover is made of hard plastic. It contains a clamp so that it may easily be attached to the urinal. The cover encloses the urinal and by a lower front area which is convex upwardly and forwardly, deters the throwing of trash onto the cover.

2 Claims, 2 Drawing Sheets

URINAL COVER

BACKGROUND OF THE INVENTION

1. Field of the Invention

This invention relates to urinal covers for out-of-order urinals in public restrooms.

2. Description of the Related Art

In public restrooms for men, an out-of-order urinal may or may not have a sign indicating its condition. If a sign is present, it is usually one which has been prepared from any available writing surface and printed with no special care. At times, the inoperative condition of the fixture is indicated by masking tape attached to the fixture at odd angles. Plastic or paper bags may be taped to the fixture to indicate its inoperative condition.

All of these measures are unsightly, and a give a poor impression of the establishments in which the fixtures are located. Additionally, the presence of an out-of-order urinal tends to serve as a target for cigarette butts or wads of paper towels, which add to the unsightly appearance of the urinal.

SUMMARY OF THE INVENTION

The purpose of the present invention is to solve the above problems by providing an inexpensive cover for out-of-order urinals which would not be unsightly in appearance and would serve as a deterrent to the tossing of trash into the urinal.

DESCRIPTION OF THE PREFERRED EMBODIMENTS

Figure 1C:
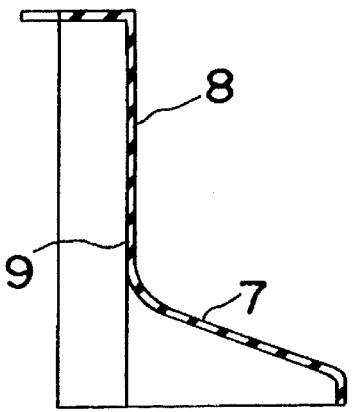
FIG. 1*c* is a cross-sectional view of the urinal cover of FIG. 1*b*, taken along line A—A of FIG. 1*b*.

With reference to the above drawing, a detailed description of the invention will now be set forth. Identical or equivalent features of different embodiments will be identified by the same numerals throughout the description.

A conventional urinal 1 has a waterpipe 2 leading from a main waterpipe (not shown) for introducing water into an open area 3 of the urinal 1. A drain 4 is conventionally located at the lower end of the urinal.

In general, the cover 5 of the present invention is a hard, plastic covering designed so that the size and shape of the cover will allow the open area 3 of the urinal 1 to be enclosed by the cover 5. The cover 5 has a least one clamp 6 to secure the cover 5 in place. In order to deter the throwing of articles onto the cover 5, the cover 5 has a lower-front portion 7 which is convex upwardly and forwardly.

Figure 1B:
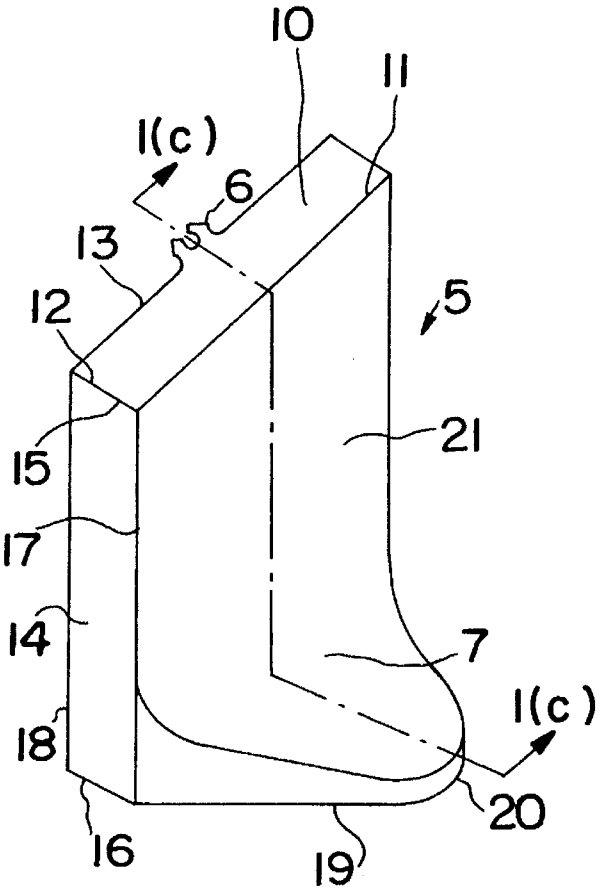
FIG. 1*b* is a perspective view of a cover of the present invention to be used on the urinal of FIG. 1*a*.
Figure 1A:
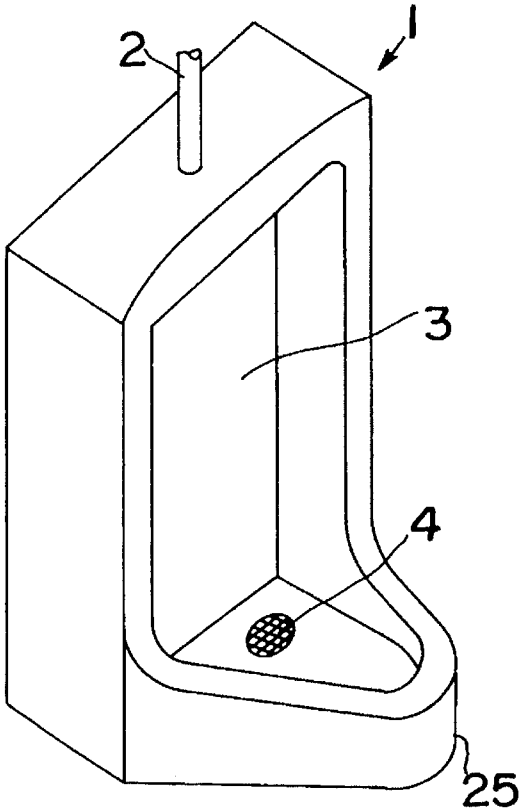
FIG. 1*a* is a perspective view of a typical urinal.

A first specific embodiment of this invention is disclosed in FIG 1(*a–c*). This urinal cover 5 is of such a size and shape as to fit over a urinal 1 and cover the open area 3 of the urinal

1. In this embodiment, the urinal cover 5 has a front aspect or surface 8 and a rear aspect or surface 9.

The cover 5 has a top section 10 which comprises a front edge 11, two side edges 12, a rear edge 13, and a flexible clamping means 6. Although a specific clamping means 6 is disclosed, it is intended that any suitable means for fixing the cover 5 to the urinal 1 is within the scope of this invention.

The cover 5 of the first specific embodiment contains two side sections 14 having top 15, bottom 16, front 17, and rear 18 edges, each side section 14 having a top edge 15 abutting a side edge 12 of the top section 10. Further, each side section 14 has a forward-directed and inwardly directed extension 19 adjacent the bottom edge 16. These two extension 19 meet at the forward point 20 of the urinal cover 5 to form a convex protrusion.

The cover 5 has a front section 21 which abuts the front edges 11 17 of the top 10 and side 14 sections. The front section 21 is solid, and thus closes off the open area 3 of the urinal 1 when secured in place. In order to deter the tossing of trash onto the urinal cover 5, which would still result in an unsightly condition, the lower-front area 7 of the front section 10 is convex upwardly and forwardly so that any trash thrown onto the cover 5 will drop to the floor. Some may find discarding trash into an out-of-order urinal, rather than the available trash can, to be acceptable. However, the same people find the discarding of trash by throwing in onto the floor to be unacceptable, and would therefore use the available trash can.

Figure 2C:
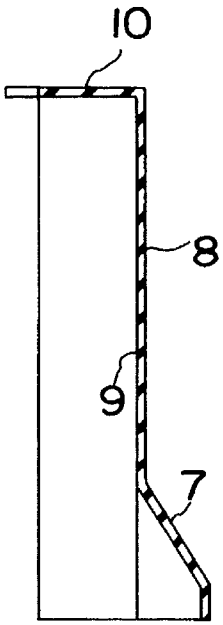
FIG. 2*c* is a longitudinal cross-sectional view of the cover of the present invention taken along line A—A of FIG. 2*b*.
Figure 2B:
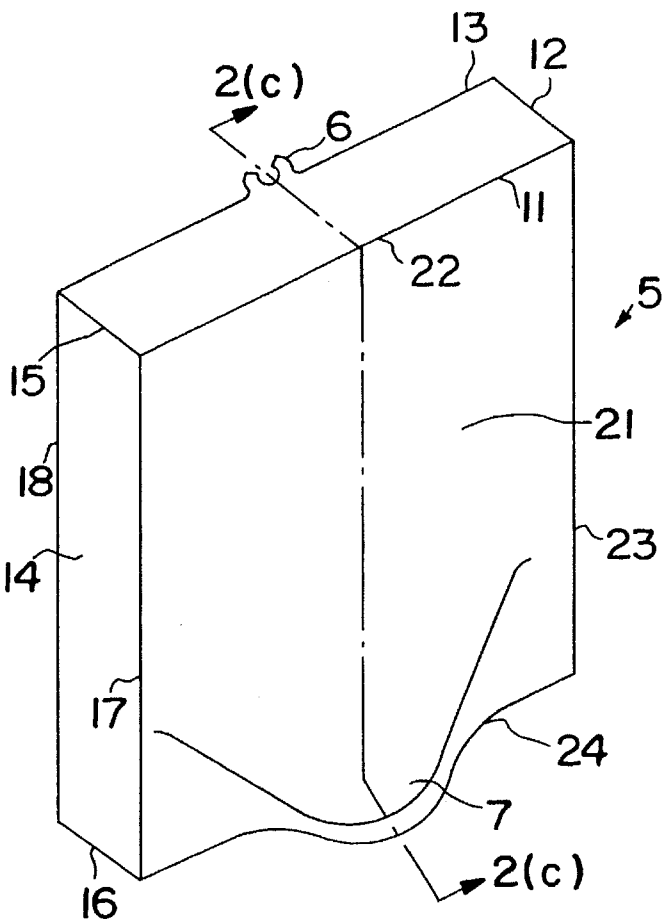
FIG. 2*b* is with a perspective view of a cover of the invention suitable for use with the urinal of FIG. 2*a*.
Figure 2A:
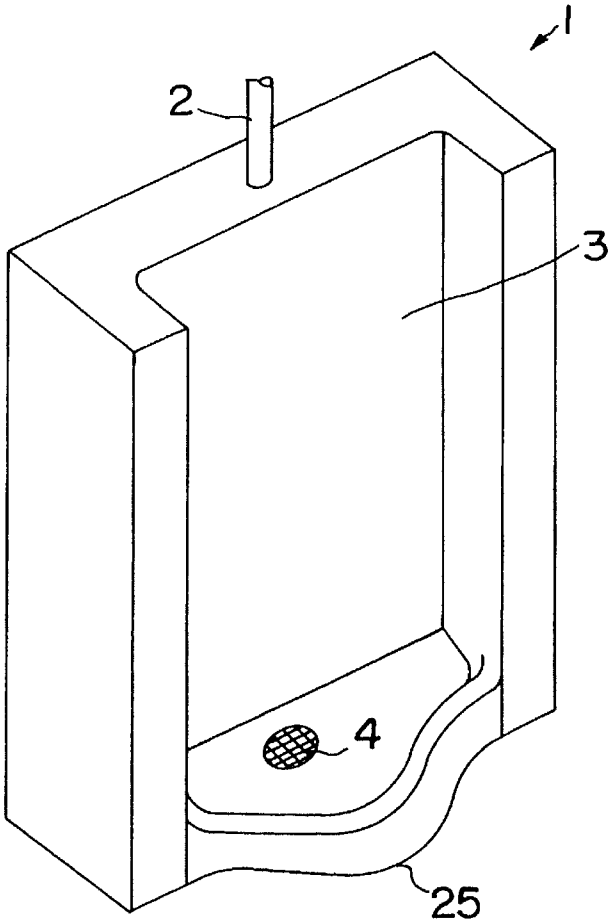
FIG. 2*a* is a perspective view of another style of urinal.

A second specific embodiment of the present invention is illustrated in FIG. 2(*a–c*). This specific embodiment involves another style urinal 1. The urinal cover 5 of this embodiment is made of hard plastic. The urinal cover 5 has front 8 and rear 9 aspects, a top section 10, side sections 14, and a front section 21.

The top section 10 has a rear edge 13, side edges 12, and a front edge 11. A flexible clamping means 6 which is capable of attaching to the water inlet pipe 2 is extended from the rear edge 13. Each side section 14 has rear edge 18, front 17, top 15, and bottom 16 edges, the top edge 15 abutting the side edges 12 of the top section 10. The cover 5 has a front section 21 having a top edge 22, side edges 23 and a bottom edge 24. The top edge 22 abuts the front edge 11 of the top section 10, the side edges 23 abut the front edges 17 of the side sections 14. The bottom edge 24 is formed so as to be of a size and shape to cover the forward point 25 of a urinal 1. The lower-front area 7 of the front section 21 is convex upwardly and forwardly so a to cause any trash thrown on the urinal cover 5 to drop to the floor.

By using the covers 5 of the present invention, the presence of unsightly, trash-filled, out-of-order urinals will is avoided and patrons are more inclined to deposit trash in the proper receptacles.

We claim:

1. A cover for a vertically oriented wall urinal having an open area bound its bottom by a forward point; said cover having front and rear surfaces and comprising:

a top section having front and rear edges, side edges, and a flexible clamping means extending from the rear edge;

two side sections having top, bottom, front, and rear edges, each side section having the top edge abutting a side edge of the top section, each side section having an extension forwardly and inwardly directed from the top edge of each side section adjacent the bottom edge, which extensions meet a forward point of the urinal cover to form a convex protrusion;

a front section which abuts the front edge of the top section and the front edges of the side sections, the front section having a lower-front area which is convex upwardly and outwardly and joins the convex protrusion, the urinal cover being of such size and shape that when positioned on a urinal, it encloses the open area of the urinal including the convex protrusion covering the forward point.

2. The cover of claim 1, wherein the cover is constructed of plastic.

* * * * *